US007802634B2

(12) United States Patent
Boone

(10) Patent No.: US 7,802,634 B2
(45) Date of Patent: Sep. 28, 2010

(54) INTEGRATED QUILL POSITION AND TOOLFACE ORIENTATION DISPLAY

(75) Inventor: Scott G. Boone, Houston, TX (US)

(73) Assignee: Canrig Drilling Technology Ltd., Magnolia, TX (US)

( * ) Notice: Subject to any disclaimer, the term of this patent is extended or adjusted under 35 U.S.C. 154(b) by 55 days.

(21) Appl. No.: 12/339,350

(22) Filed: Dec. 19, 2008

(65) Prior Publication Data

US 2009/0159336 A1 Jun. 25, 2009

Related U.S. Application Data

(60) Provisional application No. 61/016,093, filed on Dec. 21, 2007.

(51) Int. Cl.
*E21B 47/024* (2006.01)

(52) U.S. Cl. ..... 175/45; 702/9

(58) Field of Classification Search ..... 175/45, 175/61, 73; 702/9; 73/152.43, 152.46
See application file for complete search history.

(56) References Cited

U.S. PATENT DOCUMENTS

| | | | | |
|---|---|---|---|---|
| 1,891,329 | A | 12/1932 | Le Compte et al. | |
| 2,005,889 | A | 6/1935 | Dillon et al. | |
| 2,724,574 | A | 11/1955 | Ledgerwood Jr. | |
| 3,223,183 | A | 12/1965 | Varney | |
| 3,265,359 | A | 8/1966 | Bowden | |
| 3,407,886 | A | 10/1968 | Bennett | |
| 3,550,697 | A | 12/1970 | Hobhouse | |
| 4,492,276 | A | 1/1985 | Kamp | |
| 4,535,972 | A | 8/1985 | Millheim et al. | |
| 4,662,608 | A | 5/1987 | Ball | |
| 4,854,397 | A | 8/1989 | Warren et al. | |
| 4,958,125 | A | 9/1990 | Jardine et al. | |
| 5,103,919 | A * | 4/1992 | Warren et al. | 175/45 |
| 5,205,163 | A | 4/1993 | Sananikone | |
| 5,358,059 | A | 10/1994 | Ho | |
| 5,390,748 | A | 2/1995 | Goldman | |
| 5,467,832 | A | 11/1995 | Orban et al. | |
| 5,474,142 | A | 12/1995 | Bowden | |

(Continued)

FOREIGN PATENT DOCUMENTS

EP 0774563 B1 7/2002

(Continued)

OTHER PUBLICATIONS

Petroleum Extension Service, "Controlled Directional Drilling," N. Janicek (ed.), Third Edition, pp. 18-33 and 44-45, 1984.

(Continued)

*Primary Examiner*—David J Bagnell
*Assistant Examiner*—Blake Michener
(74) *Attorney, Agent, or Firm*—Haynes and Boone, LLP

(57) ABSTRACT

Method and apparatus for visibly demonstrating a relationship between toolface orientation and quill position by: (1) receiving electronic data on an on-going basis, wherein the electronic data includes quill position data and at least one of gravity-based toolface orientation data and magnetic-based toolface orientation data; and (2) displaying the electronic data on a user-viewable display in a historical format depicting data resulting from a most recent measurement and a plurality of immediately prior measurements.

32 Claims, 2 Drawing Sheets

U.S. PATENT DOCUMENTS

| | | | | |
|---|---|---|---|---|
| 5,551,286 | A | 9/1996 | Booer | |
| 5,713,422 | A | 2/1998 | Dhindsa | |
| 5,730,234 | A | 3/1998 | Putot | |
| 5,738,178 | A | 4/1998 | Williams et al. | |
| 5,842,149 | A | 11/1998 | Harrell et al. | |
| 6,026,912 | A | 2/2000 | King et al. | |
| 6,029,951 | A | 2/2000 | Guggari | |
| 6,050,348 | A | 4/2000 | Richardson et al. | |
| 6,065,332 | A | 5/2000 | Dominick | |
| 6,092,610 | A | 7/2000 | Kosmala et al. | |
| 6,192,998 | B1 | 2/2001 | Pinckard | |
| 6,382,331 | B1 | 5/2002 | Pinckard | |
| 6,405,808 | B1 | 6/2002 | Edwards et al. | |
| 6,802,378 | B2 * | 10/2004 | Haci et al. | 175/26 |
| 6,820,702 | B2 | 11/2004 | Niedermayr et al. | |
| 6,892,812 | B2 | 5/2005 | Niedermayr et al. | |
| 7,000,710 | B1 | 2/2006 | Umbach | |
| 7,032,689 | B2 | 4/2006 | Goldman et al. | |
| 7,059,427 | B2 | 6/2006 | Power et al. | |
| 7,085,696 | B2 | 8/2006 | King | |
| 7,096,979 | B2 | 8/2006 | Haci et al. | |
| 2002/0104685 | A1 | 8/2002 | Pinckard et al. | |
| 2003/0024738 | A1 | 2/2003 | Schuh | |
| 2004/0028476 | A1 | 2/2004 | Payne et al. | |
| 2007/0203651 | A1 | 8/2007 | Blanz et al. | |
| 2007/0256861 | A1 | 11/2007 | Hulick | |
| 2008/0156531 | A1 * | 7/2008 | Boone et al. | 175/27 |
| 2009/0078462 | A1 | 3/2009 | Boone | |
| 2009/0090555 | A1 | 4/2009 | Boone et al. | |

FOREIGN PATENT DOCUMENTS

| | | |
|---|---|---|
| WO | WO 93/12318 | 6/1993 |
| WO | WO 2004/055325 | 7/2004 |
| WO | WO 2008/070829 | 6/2008 |
| WO | WO 2008/070829 | 12/2008 |

OTHER PUBLICATIONS

Goldman, "Artificial Intelligence Applications Enhance Directional Control," *Petroleum Engineer International*, pp. 15-22, Feb. 1993.

Bonner, et al., "Measurements at the Bit: A New Generation of MWD Tools," *Oilfield Review*, pp. 44-54, Apr./Jul. 1993.

Jackson, et al., "Portable Top Drive Cuts Horizontal Drilling Costs," *World Oil Magazine*, vol. 214 Issue 11, pp. 81-89, Nov. 1993.

Murch, "Application of Top Drive Drilling to Horizontal Wells," Society of Petroleum Engineers—SPE 37100, 1996.

Plaintiff's Original Complaint; Case 6:09-cv-00414; Doc. 1; Sep. 16, 2009.

Answer to Plaintiff's Complaint; Case 6:09-cv-00414-LED; Doc 25; Nov. 6, 2009.

Defendant Helmerich & Payne's Invalidity Contentions; Case 6:09-cv-00414-LED; Mar. 25, 2010.

Defendant Omron Oilfield and Marine, Inc's Patent Rule 3-3 Disclosures; Case 6:09-cv-00414-LED; Mar. 25, 2010.

Defendant Omron Oilfield and Marine, Inc's Patent Rule 3-4 Disclosures; Case 6:09-cv-00414-LED; Mar. 25, 2010.

Helmerich & Payne, Inc.'s First Amended Answer and Counterclaims to Plaintiff's Original Complaint; Case 6:09-cv-00414-LED; Doc 55; Mar. 25, 2010.

Young, Jr., "Computerized Drilling Control," *Journal of Petroleum Technology*, 21(4): 483-96 (1969).

Brett, et al., "Field Experiences with Computer-Controlled Drilling," *Society of Petroleum Engineers 20107*, presented at *Permian Basin Oil and Gas Recovery Conference*, Midland, TX (Mar. 8-9, 1990).

"Wildcat ADS Automated Drilling System," Product Brochure, National Oilwell Varco, Inc. (2006).

"40223705-Series Wildcat Services Pneumatic Automated Drilling System," *available at* http://www.nov.com/Drilling/Control_and_Advisiory_Systems/Drawworks_Control_Auto_Drilling/Auto_Drillers.aspx (last visited Oct. 8, 2009).

Brown, et al., "In-Time Data Delivery," *Oilfield Review*, 11(4): 34-55, http://www.slb.com/media/services/resources/oilfieldreview/ors99/win99/pages34_55.pdf (Winter 1999/2000).

U.S. Appl. No. 11/668,388, filed Jul. 24, 2008, Pradeep, et al.

U.S. Appl. No. 11/747,110, filed Nov. 13, 2008, Boone.

U.S. Appl. No. 11/847,048, filed Mar. 5, 2009, Papouras, et al.

U.S. Appl. No. 11/952,511, filed Jul. 3, 2008, Boone, et al.

Gurari, E., "CIS 680: Data Structures: Chapter 19: Backtracking Algorithms;" http://www.cse.ohio-state.edu/%7Egurari/course/cis680/cis680Ch19.html (1999).

Leine, et al., "Stick-Slip Whirl Interaction in Drillstring Dynamics," *J. of Vibration and Acoustics*, 124: 209-220 (2002).

Maidla, et al., "Understanding Torque: The Key to Slide-Drilling Directional Wells," IADC/SPE Drilling Conference, IADC/SPE 87162 (2004).

Dupriest, et al., "Maximizing Drill Rates with Real-Time Surveillance of Mechanical Specific Energy," SPE/IADC Drilling Conference 92194, Amsterdam, The Netherlands, p. 1-10 (Feb. 23-25, 2005).

Dupriest, F., "Maximizing ROP with Real-Time Analysis of Digital Data and MSE," International Petroleum Technology Conference, Doha, Qatar, p. 1-8 (Nov. 21-23, 2005).

Hartley, et al., "New Drilling Process Increases Rate of Penetration, Footage Per Day," *Offshore*, 66(1): 1-5 (2006).

Dupriest, F., "Comprehensive Drill-Rate Management Process to Maximize Rate of Penetration," SPE Annual Technology Conference and Exhibition, San Antonio, Texas, SPE 102210, p. 1-9 (Sep. 24-27, 2006).

U.S. Appl. No. 12/390,229, filed Feb. 20, 2009, Boone.

The International Searching Authority, "Written Opinion of the International Searching Authority," PCT/US2007/86768, mailed Jun. 11, 2008.

* cited by examiner

INTEGRATED QUILL POSITION AND TOOLFACE ORIENTATION DISPLAY

CROSS-REFERENCE TO RELATED APPLICATION

This application claims the benefit of U.S. Provisional Application No. 61/016,093, filed Dec. 21, 2007, the entire contents of which is hereby incorporated herein in its entirety by express reference thereto.

BACKGROUND

Underground drilling involves drilling a bore through a formation deep in the Earth by connecting a drill bit to a drill string. During rotary drilling, the drill bit is rotated by a top drive or other rotary drive means at the surface, where a quill and/or other mechanical means connects and transfers torque between the rotary drive means and the drill string. During drilling, the drill bit is rotated by a drilling motor mounted in the drill string proximate the drill bit, and the drill string may or may not also be rotated by the rotary drive means.

Drilling operations can be conducted on a vertical, horizontal, or directional basis. Vertical drilling refers to drilling in which the trajectory of the drill string is inclined at less than about 10° relative to vertical. Horizontal drilling refers to drilling in which the drill string trajectory is inclined about 90° from vertical. Directional drilling refers to drilling in which the trajectory of the drill string is being deliberately controlled to maintain the wellbore on the planned course. Correction runs generally refer to wells that have deviated unintentionally and must be steered or directionally drilled back to the planned course.

Various systems and techniques can be used to perform vertical, directional, and horizontal drilling. For example, steerable systems use a drilling motor with a bent housing incorporated into the bottom-hole assembly (BHA) of the drill string. A steerable system can be operated in a sliding mode in which the drill string is not rotated and the drill bit is rotated exclusively by the drilling motor. The bent housing steers the drill bit in the desired direction as the drill string slides through the bore, thereby effectuating directional drilling. Alternatively, the steerable system can be operated in a rotating mode in which the drill string is rotated while the drilling motor is running.

Rotary steerable tools can also be used to perform directional drilling. One particular type of rotary steerable tool can include pads or arms located on the drill string adjacent the drill bit and extending or retracting at some fixed orientation during some or all revolutions of the drill string. Contact the between the arms and the surface of the wellbore exerts a lateral force on the drill string adjacent the drill bit, which pushes or points the drill bit in the desired direction of drilling.

Directional drilling can also be accomplished using rotary steerable motors which include a drilling motor that forms part of the BHA, as well as some type of steering means, such as the extendable and retractable arms discussed above. In contrast to steerable systems, rotary steerable motors permit directional drilling to be conducted while the drill string is rotating. As the drill string rotates, frictional forces are reduced and more bit weight is typically available for drilling. Hence, a rotary steerable motor can usually achieve a higher rate of penetration during directional drilling relative to a steerable system, since more of the combined torque and power of the drill string rotation and the downhole motor are available to be applied to the bit, because of the friction reduction in the wellbore induced by the constant rotation.

Directional drilling requires real-time knowledge of the angular orientation of a fixed reference point on the circumference of the drill string in relation to a reference point on the wellbore. The wellbore reference point is typically magnetic north in a vertical well, or the high side of the bore in an inclined well. This orientation of the drillstring reference point relative to the fixed reference point is typically referred to as toolface. For example, drilling with a steerable motor requires knowledge of the toolface so that the pads can be extended and retracted when the drill string is in a particular angular position, so as to urge the drill bit in the desired direction.

When based on a reference point corresponding to magnetic north, toolface is commonly referred to as magnetic toolface (MTF). When based on a reference point corresponding to the high side of the bore, toolface is commonly referred to as gravity tool face (GTF). GTF is usually determined based on measurements of the transverse components of the local gravitational field, i.e., the components of the local gravitational field perpendicular to the axis of the drill string, which are typically acquired using an accelerometer and/or other sensing device included with the BHA. MTF is usually determined based on measurements of the transverse components of the Earth's local magnetic field, which are typically acquired using a magnetometer and/or other sensing device included with the BHA.

Obtaining, monitoring, and adjusting the drilling direction conventionally requires that the human operator must manually scribe a line or somehow otherwise mark the drill string at the surface to monitor its orientation relative to the downhole tool orientation. That is, although the GTF or MTF can be determined at certain time intervals, the top drive or rotary table orientation is not known automatically. Consequently, the relationship between toolface and the quill position can only be estimated by the human operator. It is known that this relationship is substantially affected by reactive torque acting on the drill string and bit. Consequently, there has been a long-felt need to more accurately gauge the relationship between toolface and quill position so that, for example, directional drilling can be more accurate and efficient.

SUMMARY

The invention encompasses a method of visibly demonstrating a relationship between toolface orientation and quill position by operating a drilling apparatus including a bit with a toolface and a top drive, steering the bit with the top drive, receiving electronic data on a recurring basis, wherein the electronic data includes quill position data and at least one of gravity-based toolface orientation data and magnetic-based toolface orientation data and displaying the electronic data on a user-viewable display in a historical format depicting data resulting from a most recent measurement and a plurality of immediately prior measurements.

In one embodiment, the electronic data also includes azimuth data relating to the azimuth orientation of the drill string adjacent the bit. In another embodiment, the electronic data further includes inclination data relating to the inclination of the drill string adjacent the bit. In yet another embodiment, the quill position data may relate the orientation of the quill, top drive, Kelly, and/or other rotary drive apparatus to the toolface. In a further embodiment, the receiving electronic data includes receiving the electronic data from a downhole sensor/measurement apparatus. In another embodiment, the method includes associating the electronic data with time indicia based on specific times at which measurements yielding the electronic data were performed.

In one embodiment, displaying the electronic data includes displaying the most current data textually, and displaying the older data graphically. In a preferred embodiment, the displaying of the older data graphically includes graphically displaying the data as a target-shaped representation. In another preferred embodiment, the displaying of the older data graphically includes displaying time-dependent or time-specific icons, each being user-accessible to temporarily display data associated with that time. In a more preferred embodiment, the icons each include at least one of a number, text, color, or other indication of age relative to other icons. In another more preferred embodiment, the icons are arranged on the display by time, with the relatively newer being disposed relatively closer to the target edge and the relatively older being disposed relatively closer to the dial center. In yet a further more preferred embodiment, the icons depict the change in time from (1) the measurement being recorded by a corresponding sensor device on at least one of the bottom hole assembly and the top drive to (2) the current computer system time.

The invention also includes an apparatus adapted for human control during a drilling operation to monitor the relationship between toolface orientation and quill position, the apparatus including a drilling apparatus including a steerable motor with a toolface and a top drive adapted to steer the bit during the drilling operation, receiving apparatus adapted to recite electronic data on a recurring basis, wherein the electronic data includes quill position data and at least one of gravity-based toolface orientation data and magnetic-based toolface orientation data, and a display apparatus adapted to display the electronic data on a user-viewable display in a historical format depicting data resulting from a recent measurement and a plurality of immediately prior measurements.

The invention also encompasses an apparatus for drilling that includes a drilling apparatus including a bottom hole assembly and a top drive, the bottom hole assembly including a bit and steerable motor with a toolface and the top drive being configured to steer the bottom hole assembly, and a human-machine interface adapted to permit a human operator to monitor the relationship between toolface orientation and quill position of the drilling apparatus during a drilling operation, wherein the interface is in communication with the drilling apparatus and includes a graphical reference depicting a historical format for recent measurements and a plurality of immediately prior measurements, a set of first informational icons representing quill position data in a historical format, the first information icons overlapping the graphical reference, and a set of second informational icons representing at least one of gravity-based toolface orientation data and magnetic-based toolface orientation data in a historical format, the second information icons overlapping the graphical reference.

In one embodiment, the graphical reference is a target-shaped time representation. In another embodiment, the sets of first and second informational icons each include time indicia based on specific times at which measurements yielding the electronic data were performed. In yet another embodiment, the apparatus includes the relatively more current data being displayed textually and the relatively less current data being displayed on the graphical reference. In a preferred embodiment, the immediately prior data includes time-dependent or time-specific icons. In another preferred embodiment, the icons each include at least one of a number, text, color, or other indication of age relative to other icons. In yet another preferred embodiment, the icons are arranged by time, the relatively newer being closer to the target edge and the relatively older being closer the target center. In another embodiment, the icons depict the difference in time between the time a measurement was recorded by a corresponding sensor device and the current computer system time.

In one embodiment, the display of the apparatus includes a data legend identifying the data represented by the first and second information icons. In another embodiment, this includes the inclination and the azimuth of the steerable motor. In yet another embodiment, the apparatus includes the depth of the bottom hole assembly. In a further embodiment, the graphical display includes a target shape formed of a plurality of nested rings, and the current toolface orientation is displayed at the center of the target shape. In another embodiment, the graphical display includes a target shape formed of a plurality of nested rings, and the current toolface orientation is displayed at the center of the target shape.

The invention also encompasses an apparatus for drilling including a drilling apparatus including a bottom hole assembly and a top drive, the bottom hole assembly including a bit and a steerable motor with a toolface, and the top drive being configured to steer the bottom hole assembly, and a human-machine interface adapted to monitor the relationship between toolface orientation and quill position of the drilling apparatus during a drilling operation, the interface being in communication with the drilling apparatus and the interface including a target-like graphical reference including a plurality of nested rings depicting a historical format for recent measurements and a plurality of immediately prior measurements, the nested rings having levels representing time or measurement increments, data indicating the most recent toolface orientation represented in a center portion of the target-like graphical reference, a plurality of quill position data icons arranged in a historical format on the target-like graphical reference, each of the plurality of quill position data icons being disposed at a different level in the nested rings with the relatively more recent quill position data icons being disposed closer to the outer edge of the target-like graphical reference and the relatively less recent quill position data icons being disposed closer to the center of the target-like graphical reference, a plurality of toolface orientation data icons arranged in a historical format on the target-like graphical reference, each of the plurality of toolface orientation data icons being disposed at a different level in the nested rings, the relatively more recent toolface orientation data icons being disposed closer to the outer edge of the target-like graphical reference and the relatively less recent toolface orientation data icons being disposed closer to the center of the target-like graphical reference. In one embodiment, the data icons include a value indicating the time passed since the measurement represented by the data icon was obtained.

The invention also encompasses a computer readable medium accessible by a processor to graphically display the relationship between a toolface orientation and a quill position of a drilling apparatus, the computer readable medium including a memory component having executable instructions stored thereon, the instructions including instructions for receiving electronic data on a recurring basis received from a drilling apparatus that includes a top drive having a quill and a bottom hole assembly having a tool face, wherein the electronic data includes quill position data and at least one of gravity-based toolface orientation data and magnetic-based toolface orientation data, and instructions for graphically displaying a portion of the electronic data on a user-viewable display in a historical format depicting data resulting from a recent measurement and a plurality of immediately prior measurements.

In one embodiment, displaying the older data graphically includes graphically displaying the data as a target-shaped representation. In another embodiment, displaying the older data graphically includes displaying time-dependent or time-specific icons, each being user-accessible to temporarily display data associated with that time. In a preferred embodiment, the icons include at least one of a number, text, color, or other indication of age relative to other icons. In another preferred embodiment, the icons are arranged on the display by time, with relatively newer being disposed relatively closer to the target edge and relatively older being disposed relatively closer to the dial center.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
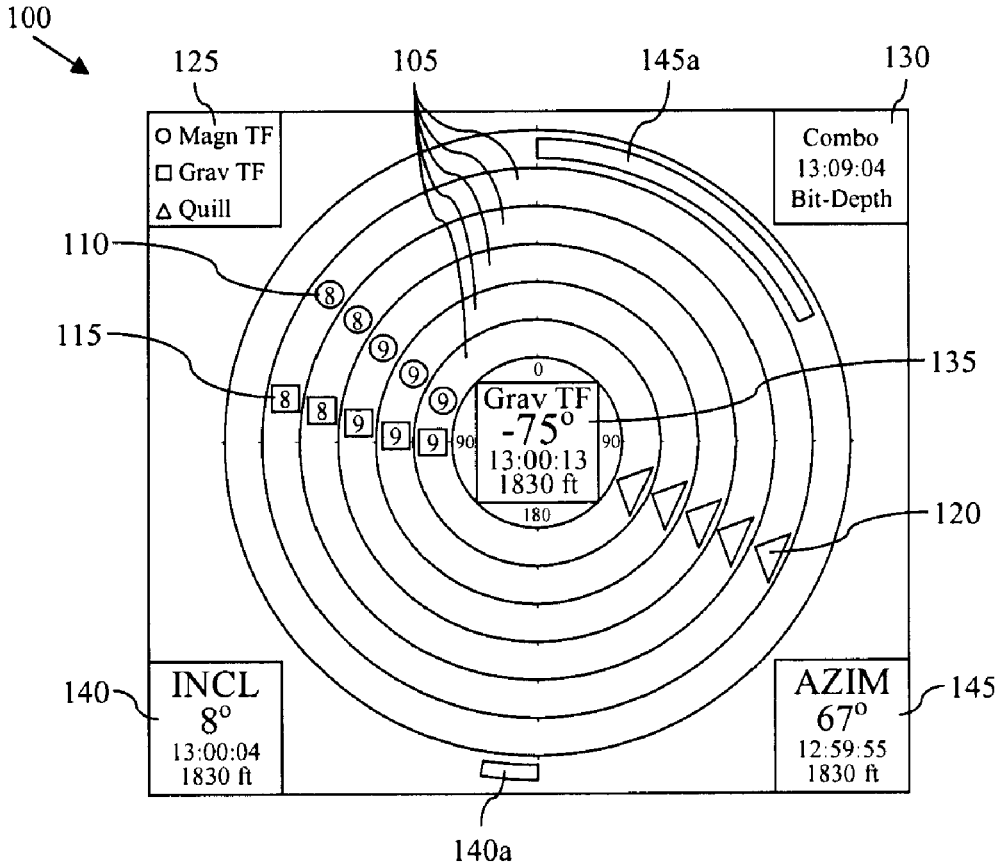
FIG. 1 is a schematic view of a display according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

As used in the present disclosure, the term "quill position" may refer to the static rotational orientation of the quill relative to the rotary drive and/or some other predetermined reference. "Quill position" may alternatively or additionally refer to the dynamic rotational orientation of the quill, such as where the quill is oscillating in clockwise and counterclockwise directions about a neutral orientation that is substantially midway between the maximum clockwise rotation and the maximum counterclockwise rotation, in which case the "quill position" may refer to the relation between the neutral orientation or oscillation midpoint and some other predetermined reference. Moreover, the "quill position" may herein refer to the rotational orientation of a rotary drive element other than the quill conventionally utilized with a top drive. For example, the quill position may refer to the rotational orientation of a rotary table or other surface-residing component utilized to impart rotational motion or force to the drill string. In addition, although the present disclosure may sometimes refer to a display integrating quill position and toolface orientation, such reference is intended to further include reference to a display integrating drill string position or orientation at the surface with the downhole toolface orientation.

Referring to FIG. 1, illustrated is a schematic view of a human-machine interface (HMI) 100 according to one or more aspects of the present disclosure. The HMI 100 may be utilized by a human operator during directional and/or other drilling operations to monitor the relationship between toolface orientation and quill position. In an exemplary embodiment, the HMI 100 is one of several display screens selectable by the user during drilling operations, and may be included as or within the human-machine interfaces, drilling operations and/or drilling apparatus described in one or more of:

- U.S. Pat. No. 6,050,348, issued to Richarson, et al., entitled "Drilling Method and Apparatus;"
- U.S. Provisional Patent Application No. 60/869,047, filed Dec. 7, 2006, entitled "MSE-Based Drilling Operation;"
- U.S. patent application Ser. No. 11/668,388, filed Jan. 29, 2007, entitled "Method, Device and System for Drilling Rig Modification;"
- U.S. patent application Ser. No. 11/747,110, filed May 10, 2007, entitled "Well Prog Execution Facilitation System and Method;"
- U.S. patent application Ser. No. 11/847,048, filed Aug. 29, 2007, entitled "Real Time Well Data Alerts;"
- U.S. patent application Ser. No. 11/859,378, filed Sep. 21, 2007, entitled "Directional Drilling Control;" and
- U.S. Provisional Patent Application No. 60/985,869, filed Nov. 6, 2007, entitled "ΔT-Based Drilling Operation."

The entire contents of each of these references is hereby incorporated herein by express reference thereto. The HMI 100 may also be implemented as a series of instructions recorded on a computer-readable medium, such as described in one or more of these references.

The HMI 100 is used by the directional driller while drilling to monitor the bottom hole assembly (BHA) in three-dimensional space. The control system or computer which drives one or more other human-machine interfaces during drilling operation may be configured to also display the HMI 100. Alternatively, the HMI 100 may be driven or displayed by a separate control system or computer, and may be displayed on a computer display (monitor) other than that on which the remaining drilling operation screens are displayed.

The control system or computer driving the HMI 100 includes a "survey" or other data channel, or otherwise includes an apparatus adapted to receive and/or read sensor data relayed from the BHA, a measurement-while-drilling (MWD) assembly, and/or other drilling parameter measurement means, where such relay may be via the Wellsite Information Transfer Standard (WITS), WITS Markup Langauge (WITSML), and/or another data transfer protocol. Such electronic data may include gravity-based toolface orientation data, magnetic-based toolface orientation data, MWD azimuth orientation data, and/or MWD inclination orientation data, among others. In an exemplary embodiment, the electronic data includes magnetic-based toolface orientation data when the toolface orientation is less than about 7° relative to vertical, and alternatively includes gravity-based toolface orientation data when the toolface orientation is greater than about 7° relative to vertical. In other embodiments, however, the electronic data may include both gravity- and magnetic-based toolface orientation data. The MWD azimuth orientation data may relate the azimuth direction of the remote end of the drill string relative to magnetic North and/or another predetermined orientation. The MWD inclination orientation data may relate the inclination of the remote end of the drill string relative to vertical.

As shown in FIG. 1, the HMI 100 may be depicted as substantially resembling a dial or target shape having a plurality of concentric nested rings 105. The magnetic-based toolface orientation data is represented in the HMI 100 by symbols 110, and the gravity-based toolface orientation data is represented by symbols 115. The HMI 100 also includes symbols 120 representing the quill position. In the exemplary embodiment shown in FIG. 1, the magnetic toolface data symbols 110 are circular, the gravity toolface data symbols 115 are rectangular, and the quill position data symbols 120 are triangular, thus distinguishing the different types of data from each other. Of course, other shapes or visualization tools may be utilized within the scope of the present disclosure. The symbols 110, 115, 120 may also or alternatively be distinguished from one another via color, size, flashing, flashing rate, and/or other graphic means.

The symbols 110, 115, 120 may indicate only the most recent toolface (110, 115) and quill position (120) measurements. However, as in the exemplary embodiment shown in FIG. 1, the HMI 100 may include a historical representation of the toolface and quill position measurements, such that the most recent measurement and a plurality of immediately prior measurements are displayed. Thus, for example, each ring 105 in the HMI 100 may represent a measurement iteration or count, or a predetermined time interval, or otherwise indicate the historical relation between the most recent measurement (s) and prior measurement(s). In the exemplary embodiment shown in FIG. 1, there are five such rings 105 in the dial (the outermost ring being reserved for other data indicia), with each ring 105 representing a data measurement or relay iteration or count. The toolface symbols 110, 115 may each include a number indicating the relative age of each measurement. In other embodiments, color, shape, and/or other indicia may graphically depict the relative age of measurement. Although not depicted as such in FIG. 1, this concept may also be employed to historically depict the quill position data.

The HMI 100 may also include a data legend 125 linking the shapes, colors, and/or other parameters of the data symbols 110, 115, 120 to the corresponding data represented by the symbols. The HMI 100 may also include a textual and/or other type of indicator 130 of the current toolface mode setting. For example, the toolface mode may be set to display only gravitational toolface data, only magnetic toolface data, or a combination thereof (perhaps based on the current toolface and/or drill string end inclination). The indicator 130 may also indicate the current system time. The indicator 130 may also identify a secondary channel or parameter being monitored or otherwise displayed by the HMI 100. For example, in the exemplary embodiment shown in FIG. 1, the indicator 130 indicates that a combination ("Combo") toolface mode is currently selected by the user, that the bit depth is being monitored on the secondary channel, and that the current system time is 13:09:04.

The HMI 100 may also include a textual and/or other type of indicator 135 displaying the current or most recent toolface orientation. The indicator 135 may also display the current toolface measurement mode (e.g., gravitational vs. magnetic). The indicator 135 may also display the time at which the most recent toolface measurement was performed or received, as well as the value of any parameter being monitored by a second channel at that time. For example, in the exemplary embodiment shown in FIG. 1, the most recent toolface measurement was measured by a gravitational toolface sensor, which indicated that the toolface orientation was −75°, and this measurement was taken at time 13:00:13 relative to the system clock, at which time the bit-depth was most recently measured to be 1830 feet.

The HMI 100 may also include a textual and/or other type of indicator 140 displaying the current or most recent inclination of the remote end of the drill string. The indicator 140 may also display the time at which the most recent inclination measurement was performed or received, as well as the value of any parameter being monitored by a second channel at that time. For example, in the exemplary embodiment shown in FIG. 1, the most recent drill string end inclination was 8°, and this measurement was taken at time 13:00:04 relative to the system clock, at which time the bit-depth was most recently measured to be 1830 feet. The HMI 100 may also include an additional graphical or other type of indicator 140*a* displaying the current or most recent inclination. Thus, for example, the HMI 100 may depict the current or most recent inclination with both a textual indicator (e.g., indicator 140) and a graphical indicator (e.g., indicator 140*a*). In the embodiment shown in FIG. 1, the graphical inclination indicator 140*a* represents the current or most recent inclination as an arcuate bar, where the length of the bar indicates the degree to which the inclination varies from vertical.

The HMI 100 may also include a textual and/or other type of indicator 145 displaying the current or most recent azimuth orientation of the remote end of the drill string. The indicator 145 may also display the time at which the most recent azimuth measurement was performed or received, as well as the value of any parameter being monitored by a second channel at that time. For example, in the exemplary embodiment shown in FIG. 1, the most recent drill string end azimuth was 67°, and this measurement was taken at time 12:59:55 relative to the system clock, at which time the bit-depth was most recently measured to be 1830 feet. The HMI 100 may also include an additional graphical or other type of indicator 145*a* displaying the current or most recent azimuth. Thus, for example, the HMI 100 may depict the current or most recent azimuth with both a textual indicator (e.g., indicator 145) and a graphical indicator (e.g., indicator 145*a*). In the embodiment shown in FIG. 1, the graphical azimuth indicator 145*a* represents the current or most recent azimuth measurement as an arcuate bar, where the length of the bar indicates the degree to which the azimuth orientation varies from true North or some other predetermined position.

Figure 2:
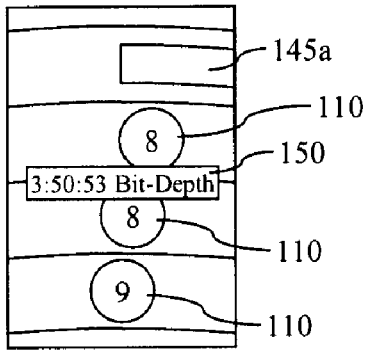
FIG. 2 is a magnified view of a portion of the display shown in FIG. 1.

Referring to FIG. 2, illustrated is a magnified view of a portion of the HMI 100 shown in FIG. 1. In embodiments in which the HMI 100 is depicted as a dial or target shape, the most recent toolface and quill position measurements may be closest to the edge of the dial, such that older readings may step toward the middle of the dial. For example, in the exemplary embodiment shown in FIG. 2, the last reading was 8 minutes before the currently-depicted system time, the next reading was also received in the $8^{th}$ minute before the currently-depicted system time, and the oldest reading was received in the $9^{th}$ minute before the currently-depicted system time. Readings that are hours or seconds old may indicate the length/unit of time with an "h" for hours or a format such as ":25" for twenty five seconds before the currently-depicted system time.

As also shown in FIG. 2, positioning the user's mouse pointer or other graphical user-input means over one of the toolface or quill position symbols 110, 115, 120 may show the symbol's timestamp, as well as the secondary indicator (if any), in a pop-up window 150. Timestamps may be dependent upon the device settings at the actual time of recording the measurement. The toolface symbols 110, 115 may show the time elapsed from when the measurement is recorded by the sensing device (e.g., relative to the current system time). Secondary channels set to display a timestamp may show a timestamp according to the device recording the measurement.

In the embodiment shown in FIGS. 1 and 2, the HMI 100 shows the absolute quill position referenced to some predetermined orientation. The HMI 100 also shows current and historical toolface data received from the downhole tools (e.g., MWD). The HMI 100, other human-machine interfaces within the scope of the present disclosure, and/or other tools within the scope of the present disclosure may have, enable, and/or exhibit a simplified understanding of the effect of reactive torque on toolface measurements, by accurately monitoring and simultaneously displaying both toolface and quill position measurements to the user.

Figure 3:
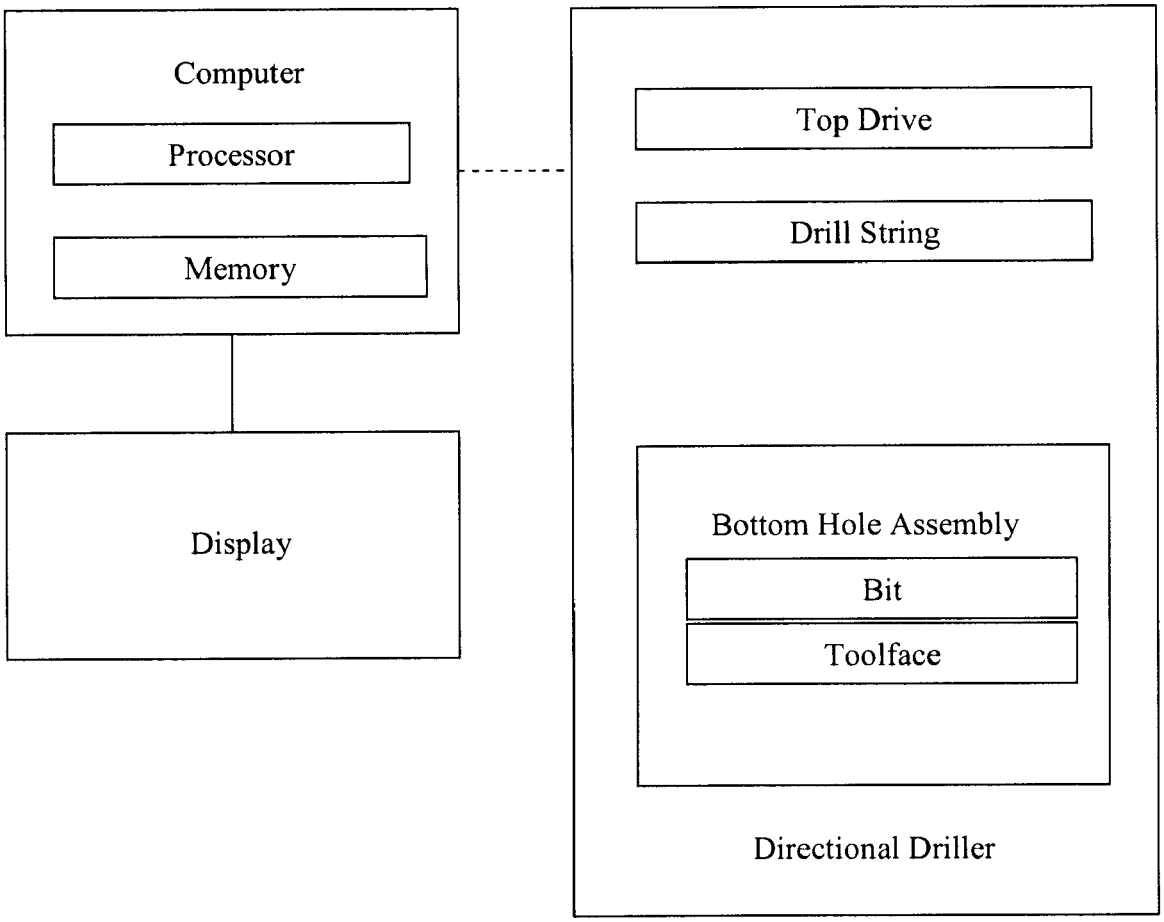
FIG. 3 is a block diagram of a system including a display and a cooperating directional driller and computer according to the invention.

FIG. 3 is a block diagram of a system including the display and a cooperating directional driller and computer. The directional driller includes a top drive that may include a quill and includes a BHA with a bit and a steerable motor with toolface. A drill string is disposed between the BHA and the top drive. The directional driller is in communication with a computer having a memory and processor and data representing the quill position and the toolface orientation is communicated from the directional driller on an ongoing basis to the computer. The computer processes the data in displays data on the display in the manner discussed herein.

In view of the above, the Figures, and the references incorporated herein, those of ordinary skill in the art should readily understand that the present disclosure introduces a method of visibly demonstrating a relationship between toolface orientation and quill position, such method including: (1) receiving electronic data on an on-going basis, wherein the electronic data includes quill position data and at least one of gravity-based toolface orientation data and magnetic-based toolface orientation data; and (2) displaying the electronic data on a user-viewable display in a historical format depicting data resulting from a most recent measurement and a plurality of immediately prior measurements. The electronic data may further include azimuth data, relating the azimuth orientation of the drill string adjacent the bit. The distance between the bit and the sensor(s) gathering the electronic data is preferably as small as possible while still obtaining at least sufficiently, or entirely, accurate readings, and the minimum distance necessary will be well understood by those of ordinary skill in the art. The electronic data may further include inclination data, relating the inclination of the drill string adjacent the bit. The quill position data may relate the orientation of the quill, top drive, Kelly, and/or other rotary drive apparatus to the toolface. The electronic data may be received from MWD and/or other downhole sensor/measurement equipment.

The method may further include associating the electronic data with time indicia based on specific times at which measurements yielding the electronic data were performed. In an exemplary embodiment, the most current data may be displayed textually and older data may be displayed graphically, such as a preferably dial- or target-shaped representation. In other embodiments, different graphical shapes can be used, such as oval, square, triangle, or rectangle, or shapes that are substantially similar but with visual differences, e.g., rounded corners, wavy lines, or the like. Nesting of the different information is preferred. The graphical display may include time-dependent or time-specific symbols or other icons, which may each be user-accessible to temporarily display data associated with that time (e.g., pop-up data). The icons may have a number, text, color, or other indication of age relative to other icons. The icons may preferably be oriented by time, newest at the dial edge, oldest at the dial center. In an alternative embodiment, the icons may be oriented in the opposite fashion, with the oldest at the dial edge and the newer information towards the dial center. The icons may depict the change in time from (1) the measurement being recorded by a corresponding sensor device to (2) the current computer system time. The display may also depict the current system time.

The present disclosure also introduces an apparatus including: (1) apparatus adapted to receive electronic data on a recurring, or ongoing, basis, wherein the electronic data includes quill position data and at least one of gravity-based toolface orientation data and magnetic-based toolface orientation data; and (2) apparatus to display the electronic data on a user-viewable display in a historical format depicting data resulting from a most recent measurement and a plurality of immediately prior measurements.

Embodiments within the scope of the present disclosure may offer certain advantages over the prior art. For example, when toolface and quill position data are combined on a single visual display, it may help an operator or other human personnel to understand the relationship between toolface and quill position. Combining toolface and quill position data on a single display may also or alternatively aid understanding of the relationship that reactive torque has with toolface and/or quill position. These advantages may be recognized during vertical drilling, horizontal drilling, directional drilling, and/or correction runs.

The foregoing outlines features of several embodiments so that those of ordinary skill in the art may better understand the aspects of the present disclosure. Those of ordinary skill in the art should appreciate that they may readily use the present disclosure as a basis for designing or modifying other processes and structures for carrying out the same purposes and/or achieving the same advantages of the embodiments introduced herein. Those of ordinary skill in the art should also realize that such equivalent constructions do not depart from the spirit and scope of the present disclosure, and that they may make various changes, substitutions and alterations herein without departing from the spirit and scope of the present disclosure.

What is claimed is:

1. A method of visibly demonstrating a relationship between toolface orientation and quill position, such method comprising:

operating a drilling apparatus comprising a bit with a steerable motor with toolface and a top drive;

steering the steerable motor and bit with the top drive;

receiving electronic data on a recurring basis, wherein the electronic data includes quill position data and at least one of gravity-based toolface orientation data and magnetic-based toolface orientation data; and displaying the electronic data on a user-viewable display in a historical format depicting data resulting from a most recent measurement and a plurality of immediately prior measurements.

2. The method of claim 1, wherein the electronic data also comprises measurement-while-drilling (MWD) azimuth data relating to the azimuth orientation of the drill string adjacent the bit.

3. The method of claim 2, wherein the electronic data further comprises MWD inclination data relating to the inclination of the drill string adjacent the bit.

4. The method of claim 1, wherein the quill position data may relate the orientation of the quill, top drive, Kelly, and/or other rotary drive apparatus to the toolface.

5. The method of claim 1, wherein receiving electronic data comprises receiving the electronic data from a downhole sensor/measurement apparatus.

6. The method of claim 1, which further comprises associating the electronic data with time indicia based on specific times at which measurements yielding the electronic data were performed.

7. The method of claim 1, wherein displaying the electronic data comprises:

displaying the most current data textually; and displaying the older data graphically.

8. The method of claim 7, wherein displaying the older data graphically includes graphically displaying the data as a target-shaped representation.

9. The method of claim 7, wherein displaying the older data graphically includes displaying time-dependent or time-specific icons, each being user-accessible to temporarily display data associated with that time.

10. The method of claim 9, wherein the icons each comprise at least one of a number, text, color, or other indication of age relative to other icons.

11. The method of claim 9, wherein the icons are arranged on the display by time, with the relatively newer being disposed relatively closer to the target edge and the relatively older being disposed relatively closer to the dial center.

12. The method of claim 11, wherein the icons depict the change in time from (1) the measurement being recorded by a corresponding sensor device on at least one of a bottom hole assembly and the top drive to (2) the current computer system time.

13. An apparatus adapted for human control during a drilling operation to monitor the relationship between toolface orientation and quill position, the apparatus comprising:

a drilling apparatus comprising a bit with a steerable motor having a toolface and a top drive adapted to steer the bit during the drilling operation;

receiving apparatus adapted to recite electronic data on a recurring basis, wherein the electronic data includes quill position data and at least one of gravity-based toolface orientation data and magnetic-based toolface orientation data; and a display apparatus adapted to display the electronic data on a user-viewable display in a historical format depicting data resulting from a recent measurement and a plurality of immediately prior measurements.

14. An apparatus for drilling, comprising:

a drilling apparatus comprising a bottom hole assembly and a top drive, the bottom hole assembly comprising a bit with a steerable motor having a toolface and the top drive being configured to steer the bottom hole assembly; and a human-machine interface adapted to permit a human operator to monitor the relationship between toolface orientation and quill position of the drilling apparatus during a drilling operation, wherein the interface is in communication with the drilling apparatus and comprises:

a graphical reference depicting a historical format for recent measurements and a plurality of immediately prior measurements;

a set of first informational icons representing quill position data in a historical format, the first information icons overlapping the graphical reference; and a set of second informational icons representing at least one of gravity-based toolface orientation data and magnetic-based toolface orientation data in a historical format, the second information icons overlapping the graphical reference.

15. The apparatus of claim 14, wherein the graphical reference is a target-shaped time representation.

16. The apparatus of claim 14, wherein the sets of first and second informational icons each comprise time indicia based on specific times at which measurements yielding the electronic data were performed.

17. The apparatus of claim 14, including the relatively more current data being displayed textually and the relatively less current data being displayed on the graphical reference.

18. The apparatus of claim 17, wherein the immediately prior data comprises time-dependent or time-specific icons.

19. The apparatus of claim 18 wherein the icons each comprise at least one of a number, text, color, or other indication of age relative to other icons.

20. The apparatus of claim 18, wherein the icons are arranged by time, the relatively newer being closer to the target edge and the relatively older being closer the target center.

21. The apparatus of claim 18, wherein the icons depict the difference in time between the time a measurement was recorded by a corresponding sensor device and the current computer system time.

22. The apparatus of claim 14, including a data legend identifying the data represented by the first and second information icons.

23. The apparatus of claim 14, including the inclination and the azimuth of the steerable motor and bit.

24. The apparatus of claim 14, comprising the depth of the bottom hole assembly.

25. The interface of claim 14, wherein the graphical display comprises a target shape formed of a plurality of nested rings, and the current toolface orientation is displayed at the center of the target shape.

26. An apparatus for drilling, comprising:

a drilling apparatus comprising a bottom hole assembly and a top drive, the bottom hole assembly comprising a bit with a steerable motor having a toolface, and the top drive being configured to steer the bottom hole assembly; and a human-machine interface adapted to monitor the relationship between toolface orientation and quill position of the drilling apparatus during a drilling operation, the interface being in communication with the drilling apparatus and the interface comprising:

a target-like graphical reference comprising a plurality of nested rings depicting a historical format for recent measurements and a plurality of immediately prior measurements, the nested rings having levels representing time or measurement increments;

data indicating the most recent toolface orientation represented in a center portion of the target-like graphical reference;

a plurality of quill position data icons arranged in a historical format on the target-like graphical reference, each of the plurality of quill position data icons being disposed at a different level in the nested rings with the relatively more recent quill position data icons being disposed closer to the outer edge of the target-like graphical reference and the relatively less recent quill position data icons being disposed closer to the center of the target-like graphical reference;

a plurality of toolface orientation data icons arranged in a historical format on the target-like graphical reference, each of the plurality of toolface orientation data icons being disposed at a different level in the nested rings, the relatively more recent toolface orientation data icons being disposed closer to the outer edge of the target-like graphical reference and the relatively less recent toolface orientation data icons being disposed closer to the center of the target-like graphical reference.

27. The apparatus of claim 26, wherein the data icons include a value indicating the time passed since the measurement represented by the data icon was obtained.

28. A computer readable medium accessible by a processor to graphically display the relationship between a toolface orientation and a quill position of a drilling apparatus, the computer readable medium comprising:

a memory component having executable instructions stored thereon, the instructions comprising:

instructions for receiving electronic data on a recurring basis received from a drilling apparatus that comprises a top drive having a quill and a bottom hole assembly having a tool face, wherein the electronic data includes quill position data and at least one of gravity-based toolface orientation data and magnetic-based toolface orientation data; and instructions for graphically displaying a portion of the electronic data on a user-viewable display in a historical format depicting data resulting from a recent measurement and a plurality of immediately prior measurements.

29. The computer readable medium of claim 28, wherein displaying the older data graphically includes graphically displaying the data as a target-shaped representation.

30. The computer readable medium of claim 28, wherein displaying the older data graphically includes displaying time-dependent or time-specific icons, each being user-accessible to temporarily display data associated with that time.

31. The computer readable medium of claim 30, wherein the icons comprise at least one of a number, text, color, or other indication of age relative to other icons.

32. The computer readable medium of claim 30, wherein the icons are arranged on the display by time, with relatively newer being disposed relatively closer to the target edge and relatively older being disposed relatively closer to the dial center.

* * * * *